US007003850B2

(12) United States Patent
Gaydos et al.

(10) Patent No.: US 7,003,850 B2
(45) Date of Patent: Feb. 28, 2006

(54) RAILROAD CAR HATCH COVER HINGE STRUCTURE AND METHOD FOR CONNECTING A HATCH COVER TO A RAILCAR

(75) Inventors: Christopher C. Gaydos, Maple Park, IL (US); Rudolph S. Fortuna, Oak Creek, WI (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 10/730,300

(22) Filed: Dec. 8, 2003

(65) Prior Publication Data

US 2005/0120516 A1 Jun. 9, 2005

(51) Int. Cl.
*E05D 1/00* (2006.01)

(52) U.S. Cl. ..... 16/235; 16/239; 105/377.01; 220/810

(58) Field of Classification Search ..... 16/235, 16/239, 247, 249, 250, 251, 347, 348, 358, 16/359, 355, 356, 387; 248/237, 213.1, 224.7, 248/224.8, 274.1; 403/157, 63; 105/377.01, 105/377.07, 221.1, 450; 49/193–195, 505, 49/503, 57, 67, 402; 296/216.01–216.02; 220/810, 836, 843, 241, 360, 244, 253, 283, 220/916

See application file for complete search history.

(56) References Cited

U.S. PATENT DOCUMENTS 1,661,294 A * 3/1928 Lemaster ..... 99/376
2,607,302 A 8/1952 Nystrom
2,648,516 A * 8/1953 Manetti et al. ..... 248/311.2
2,652,787 A 9/1953 Keleher
3,250,233 A 5/1966 Carney, Jr.
3,259,078 A 7/1966 Radey et al.
3,266,440 A 8/1966 Price et al.
3,307,498 A 3/1967 Stevens
3,848,912 A * 11/1974 Jensen et al. ..... 292/256.5
4,239,008 A 12/1980 Conlon
4,368,674 A 1/1983 Wiens et al.
4,497,514 A * 2/1985 Moriya et al. ..... 292/336.3
4,638,743 A 1/1987 Loomis
4,840,126 A 6/1989 Kleykamp
4,889,056 A * 12/1989 Stewart ..... 105/377.11
4,953,259 A * 9/1990 Frye et al. ..... 16/225
5,116,099 A * 5/1992 Kwasnik et al. ..... 297/188.15
5,517,925 A 5/1996 Early
5,738,396 A * 4/1998 Oestermeyer et al. ... 292/256.5
6,085,664 A 7/2000 Early
6,266,564 B1 7/2001 Hill et al.
6,353,970 B1 * 3/2002 Spaeth ..... 16/360
6,401,299 B1 * 6/2002 Schwarz ..... 16/335
6,435,462 B1 * 8/2002 Hawes ..... 248/299.1
6,749,262 B1 * 6/2004 Schaffner et al. ..... 297/367
6,817,062 B1 * 11/2004 Cho ..... 16/328

FOREIGN PATENT DOCUMENTS

FR 002627468 A1 * 8/1989

* cited by examiner

*Primary Examiner*—Robert J. Sandy
*Assistant Examiner*—Andre' L. Jackson
(74) *Attorney, Agent, or Firm*—John W. Harbst

(57) ABSTRACT

A hinge structure including a universal adapter located toward one end of and for allowing the hinge structure to be pivotally connected to different stationary brackets having differing pivot axes. The universal adapter defines multiple openings disposed in spaced, generally parallel relation relative to each other.

16 Claims, 3 Drawing Sheets

RAILROAD CAR HATCH COVER HINGE STRUCTURE AND METHOD FOR CONNECTING A HATCH COVER TO A RAILCAR

FIELD OF THE INVENTION

The present invention generally relates to railcar hatch covers and, more particularly to a hinge structure and method for pivotally connecting a hatch cover to a railcar.

BACKGROUND OF THE INVENTION

Railroad hopper cars have been used for years to transport particulate/granular materials. Covered railroad hopper cars are provided with a roof for protecting the hopper car contents from contaminants and weather related elements. Access to an interior of a covered railcar from above is accomplished through a hatch opening in the roof of the railcar. Cowled coaming, upstanding from the roof, typically extends peripherally about the hatch opening.

The hatch opening in the railcar roof is closed during transport by a series of individual hatch covers. In a closed position, each hatch cover lies across an upper edge of the railcar coaming and, preferably, seals the hatch opening. Along one side thereof, the hatch cover is typically provided with a series of hinge structures which are secured to an upper surface of and extend outwardly from a side of the hatch cover. Typically, a free end of the hinge structure is pivotally connected to a stationary bracket extending upwardly from the railcar roof and embracing the free end of the hinge structure. In this regard, the free end of the hinge structure is usually configured with an eye-like opening which receives an elongated hinge pin or bolt extending through aligned openings on the bracket.

As will be appreciated, there are several different manufacturers of railcars. Moreover, there are numerous hopper car designs having hatch openings of varying lengths and types and each requiring a specific hatch cover construction. To exacerbate the problem, the various railcar manufacturers design the hatch openings with coaming which extends upwardly from the railcar roof differing distances.

There are also numerous variables existing in hatch covers used with known hopper cars. Different railcar hatch openings can have different widths, different hinge pin to coaming distances, different hinge pin diameters, as well as different brackets. In view of these differences and other related variables, heretofore it has been practically impossible to provide a single hinge structure adaptable to all of these variables while maintaining a closed hatch cover in a sealed relationship relative to the railcar coaming. As such, replacement of the hinge structures to cooperate with the hinge brackets and/or replacement of the brackets on the car roof to cooperate with the hinge structures is required. Of course, replacement of either the hinge structures on the hatch covers or the hinge brackets on the railcar is a time consuming and tedious process. Moreover, due consideration needs to be given to the exposure of the hinge structures to weather related elements and the problems created by such weather related elements (i.e. corrosion) to the hinge structure components used to pivotally connect the hatch cover to the railcar.

In view of these problems and the many different variables existing in the field of hopper cars equipped with hatch covers, there is a continuing need and desire for a hinge structure configured to universally allow for pivotal securement of a railcar hatch cover to any of several different railcar constructions whereby significantly reducing the inventory a supplier must carry to satisfy the needs of the industry.

SUMMARY OF THE INVENTION

In view of the above, and in accordance with one aspect of the present invention, there is provided hinge structure including a universal adapter located toward one end of and for allowing the hinge structure to be pivotally connected to different stationary brackets having differing pivot axes. The universal adapter defines multiple openings disposed in spaced, generally parallel relation relative to each other whereby significantly enhancing the versatility of the hinge structure to differing brackets and railcar constructions.

Preferably, the universal adapter of the hinge structure defines a first opening and a second opening, which are offset relative to each other. In one form, the universal adapter is configured such that an axis defined by the first opening is positioned both upwardly and in laterally offset relation from an axis defined by the second opening.

In a preferred embodiment, each opening defined by the universal adapter has a closed and generally circular marginal edge. In a most preferred form, the closed and generally circular marginal edge of the first opening is of a different size than the closed and generally circular marginal edge of the second opening.

To further enhance hinge structure versatility, a first end of the hinge structure has a generally planar configuration to promote attachment to various structures, i.e., railcar hatch covers or the like, while the universal adapter comprises one of a plurality of interchangeable apertured pieces releasably securable toward the second end of the hinge structure. Preferably, the second end portion of the hinge structure has at least one of such pieces comprising the universal adapter releasably secured thereto in a manner inhibiting rotation of the apertured piece relative to the hinge structure. In a most preferred embodiment, the universal adapter comprises one of a plurality of modular inserts configured for interchangeability with other modular inserts within a socket arranged toward the second end of the hinge structure.

In accordance with another aspect, there is provided hinge structure for connecting a hatch cover to a railcar. The hinge structure includes a first end configured for attachment to the hatch cover and a separate universal adapter arranged toward a second end of the hinge structure. According to this aspect, the universal adapter defines multiple openings disposed in spaced, generally parallel relation relative to each other whereby permitting pivotal attachment of the hinge structure and thereby said hatch cover to different brackets on the railcar having hinge pins arranged at different heights relative to coaming on the railcar. having hinge pins arranged at different heights relative to coaming on the railcar.

According to this aspect, the adapter defines a first opening and a second opening, with the first and second openings being offset relative to each other. Preferably, the universal adapter is configured such that an axis defined by the first opening is positioned upwardly and in laterally offset relation from an axis defined by the second opening.

In a preferred form, each opening defined by the adapter is configured with a closed and generally circular-marginal edge. In a most preferred form, the closed and generally circular marginal edge of the first opening is differently sized from the closed and generally circular marginal edge of the second opening whereby allowing for different diameters hinge pins to be accommodated for use with the hinge structure.

In accordance with this embodiment, the universal adapter preferably comprises an apertured piece that is interchangeable with other apertured pieces. Preferably, each apertured piece has a series of openings arranged in a different pattern relative to each other whereby expanding the versatility of the hinge structure in combination with different railcar brackets. Moreover, in a preferred form, each apertured piece is releasably engageable with the hinge structure in a manner inhibiting rotation of such piece relative to the hinge structure. In a preferred form, each apertured piece is configured as a modular insert to be releasably accommodated within a socket defined by and toward one end of the hinge structure.

In accordance with yet another aspect, a hinge system is provided for connecting a first member to a second member for hinged movement about a fixed pivot axis. The hinge system includes a first hinge piece connected to one of the first and second members, with the first binge piece defining a reference plane, and a second hinge piece connected to the other of the first and second members. The second hinge piece accommodates a hinge pin defining the fixed pivot axis between the first and second members. Moreover, a separate universal adapter is releasably secured to one of the first and second pieces. The universal adapter defines multiple sleeve-like openings, each sized to accommodate a lengthwise portion of the hinge pin. The multiple openings in the adapter are at different distances relative to the reference plane on the first hinge piece such that differing second binge pieces having the hinge pin disposed at differing distances from the reference plane of the first hinge piece are pivotally securable to the first hinge piece by moving the hinge pin to that opening in the universal adapter closely aligned to the axis of the hinge pin accommodated by the second hinge piece.

In accordance with this aspect, the universal adapter defines a first sleeve-like opening and a second sleeve-like opening, with the first and second sleeve-like openings being vertically and laterally offset relative to each other. In a preferred form, each sleeve-like opening defined by the adapter has a closed and generally circular marginal edge, with the closed and generally circular marginal edge of the first sleeve-like opening being differently sized from the closed and generally circular marginal edge of the second sleeve-like opening.

Preferably, the universal adapter comprises one of a plurality of modular inserts. In this embodiment, a first end portion of one of the first and second pieces is configured to releasably accommodate any one of the plurality of modular inserts in non-rotatable relation relative to each other. In a most preferred form, one of the hinge pieces is configured with a socket for releasably accommodating and holding one of the modular inserts therein in non-rotatable relation relative to the hinge piece. Moreover, each modular insert has a plurality of hinge pin accommodating openings arranging in a predetermined pattern. As will be appreciated, the pattern of openings in one modular insert differs from the pattern of openings in another modular insert. Moreover, each opening in the insert defines a closed, generally circular marginal edge extending thereabout. To further promote versatility, the distance across the marginal edge defining the openings in the modular structures are of differing sizes relative to each other whereby allowing different inserts to accommodate hinge pins having differing diameters.

In accordance with still another aspect, there is provided a method for connecting a railcar hatch cover for hinged movements about a fixed axis to brackets having aligned openings for receiving a hinge pin defining the fixed axis. The method comprises the steps of: providing a hinge structure configured toward one end with a generally planar portion for facilitating attachment of the hinge structure to the hatch cover, with the planar portion on the hinge structure defining a reference plane; providing a plurality of adapters, each adapter being located toward a second end of the hinge structure, with each adapter including multiple openings arranged in generally parallel relationship relative to each other, and with each opening in the adapter being disposed a differing distance from the reference plane defined by the hinge structure, and wherein spacings between a majority of the openings in one adapter differ from the spacing between a majority of the openings in another adapter; and, selecting that adapter having an opening disposed so as to proximate a distance measurable between the pivot axis defined by the aligned openings on the brackets and the hinge structure reference plane.

According to this aspect, the openings in the various adapters each differ in size relative to each other. Moreover, and in accordance with this aspect, each adapter is configured as a removable insert which is accommodated within a socket defined toward the second end of the hinge structure.

A primary feature of this invention relates to the provision of structure which can be assembled and/or retrofitted to affect a hinged connection between a hatch cover and any of several hopper car constructions.

Another feature of the present invention relates to the provision of structure allowing for a hatch cover to be hingedly mounted to existing upstanding brackets on a railcar wherein some of the existing brackets may be different from each other or have different diameter hinge pins which may be located at differing heights relative to coaming on the railcar.

Still another feature of this invention relates to the provision of a low cost structure for connecting or mounting a railcar hatch cover to brackets of differing styles and wherein the structure includes an adapter allowing the structure to be used in different applications simply by selecting that adapter configured to accommodate a particular hinge pin diameter and/or hinge pin location.

These and other objects, aims and advantages of the invention will become more readily apparent from the following detailed description, the drawings and the appended claims.

DETAILED DESCRIPTION OF THE INVENTION

Figure 1:
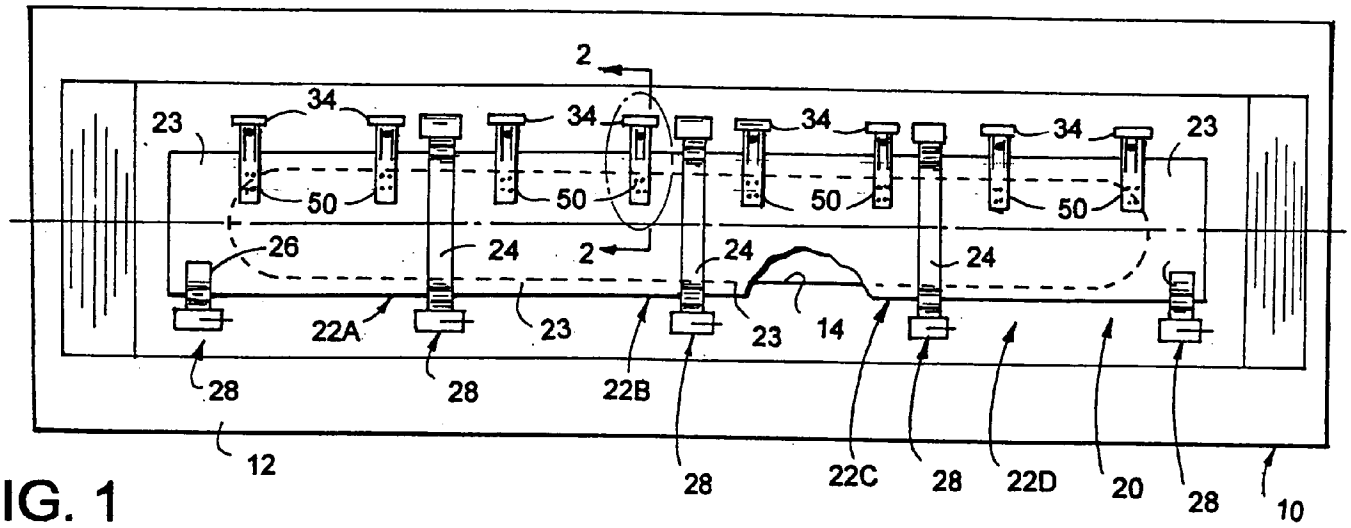
FIG. 1 is a top plan view, partially broken away, of a railroad hopper car embodying principals of the present invention.

While the present invention is susceptible of embodiment in multiple forms, there is shown in the drawings and will hereinafter be described a preferred embodiment of the invention, with the understanding the present disclosure sets forth an exemplification of the invention which is not intended to limit the invention to the specific embodiment illustrated and described.

Referring now to the drawings, wherein like reference numerals indicate like parts throughout the several views, the present invention is shown arranged in combination with a covered railroad hopper car, generally designed by reference numeral 10. Railcar 10 includes a conventional box-like structure of rigid construction including a roof 12 having an elongated longitudinally extending hatch opening or trough 14. In one form, the opening 14 is defined toward a central portion of the roof 12 for loading granular materials or commodity into the railcar 10.

The hatch opening 14 is covered by a hatch cover assembly 20. In one form, the hatch cover assembly 20 is comprised of a series of longitudinally elongated and aligned hatch covers 22A, 22B, 22C and 22D arranged in end-to-end relation relative to each other. As will be appreciated, the hatch cover assembly 20 can include more or less hatch covers than that shown without detracting or departing from the spirit and scope of the invention.

As known, each hatch cover 22A through 22D has a generally flat main panel 23 adapted to be positioned over and sized to close the opening 14. In the illustrated embodiment, hatch covers 22A through 22D are individually movable between open and closed positions relative to the hatch opening 14. In one form, the hatch covers 22A through 22D are maintained in a closed position by conventional batten bars 24 and hold downs 26. As is known, one end of each batten bar 24 is pivotally secured to the roof 12 and extends across end regions of adjacent hatch covers. An opposite end of each batten bar 24 and the free end of each hold down 26 is releasably secured to the roof 12 by a conventional latch structure 28 similar to that disclosed in U.S. Pat. No. 4,635,979 to O. E. Blume; the applicable portions of which are incorporated herein by reference.

Figure 2:
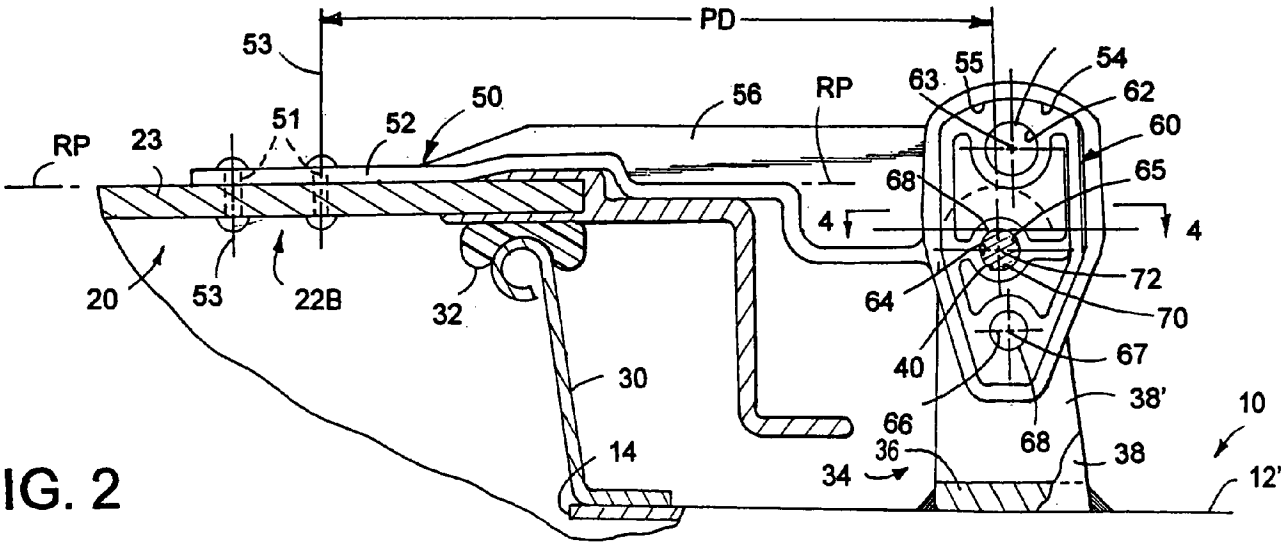
FIG. 2 is a sectional view taken along line 2—2 of FIG. 1.

As shown in FIG. 2, an upstanding flange or coaming 30 extends around the periphery of the hatch opening 14. Coaming 30 protrudes, in water-tight relation, upwardly from the roof 12 and terminates preferably in a rolled upper edge or lip. A gasket 32 is bonded or otherwise secured to an inner side or surface of each hatch cover at a location to effect a seal against the rolled edge of the railcar coaming 30 when the hatch cover is closed. With the hatch cover properly positioned over the opening 14, gasket 32 deforms against the edge portion of the coaming 30 to provide a tight seal inhibiting moisture and other foreign material from contaminating the contents in the car 10.

Figure 3:
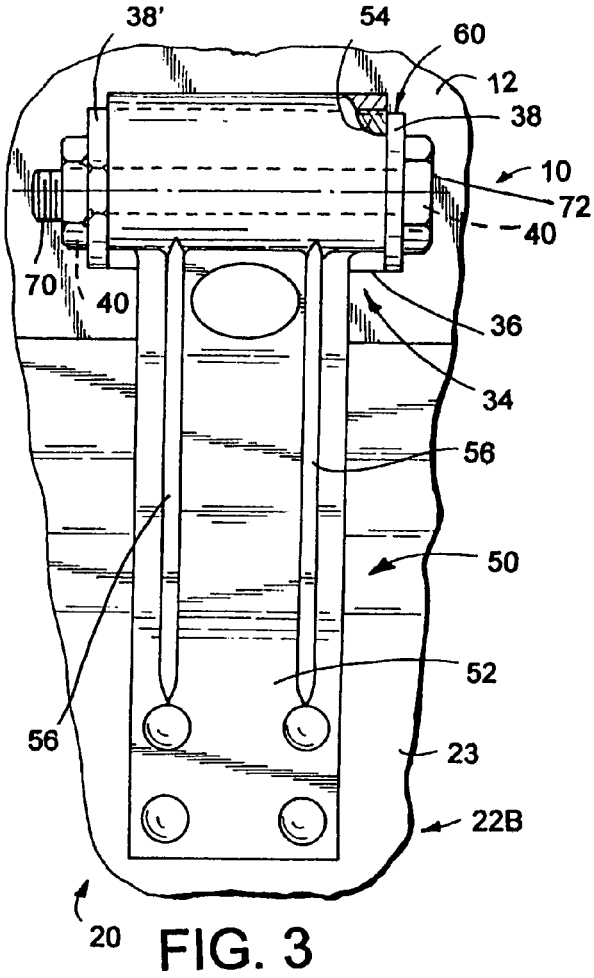
FIG. 3 is an enlarged view of that area encircled in FIG. 1.

Returning to FIG. 1, a plurality of stationary hinge pin brackets 34 are located on the railcar roof 12 along one side of the hatch opening 14. Generally, the hinge pin brackets 34 secured to the railcar roof 12 are substantially similar relative to each other. Accordingly, only a single hinge pin bracket 34 will be described in detail and will suffice for an understanding of the hinge pin brackets 34 secured to the railcar roof 12. As shown in FIGS. 2 and 3, each stationary pin bracket 34 typically includes a base 36, welded or otherwise secured to the railcar roof 12, and a pair of spaced arms 38 and 38', formed integral with and extending upright from the base 36. As shown in FIG. 3, the arms 38, 38' define a pair of horizontally aligned hinge pin holes or openings 40 disposed a predetermined height above the railcar roof 12. Although only one hopper car 10 is illustrated for exemplary purposes, and largely because of the number of different railcar builders, it will be appreciated the disposition of the hinge pin holes or openings 40 relative to the railcar coaming 30 (FIG. 2) are not always constant between car designs.

In accordance with the present invention, hinge structure 50 is provided for permitting the hatch covers 22A through 22D to be connected quickly and easily even to differing stationary brackets 34 on the railcar 10. That is, the hinge structure 50 of this invention advantageously allows the hatch cover assembly 20 to be mounted in operable combination with and connected to brackets 34 designed with hinge pin holes or openings 40 disposed at differing heights relative to the railcar coaming 30 as well as brackets 34 having different diameter hinge pins and differing widths.

As shown in FIG. 2, hinge structure 50 is configured toward one end thereof to promote attachment of the hinge structure 50 toward one side of the main panel 23 of the respective hatch cover associated therewith. As shown in FIGS. 2 and 3, hinge structure 50 has a separate universal adapter 60 located or arranged toward a second end thereof. As shown in FIGS. 2 and 3, the second end of the hinge structure 50, along with the adapter 60 carried thereby, is spaced from the one side of the main panel 23 to which the first end of the hinge structure 50 is attached. The universal adapter 60 is configured to promote attachment and mounting of hinge structure 50 and, thus, the respective hatch cover 50 to various brackets 34 as through a hinge pin 70 journaled by the arms 38, 38' of the brackets 34 and the universal adapter 60 of the hinge structure 50 whereby allowing for hinged movement of the hatch cover between closed and open positions and about a fixed axis 72 defined by hinge pin 70.

In a preferred embodiment, hinge structure 50 includes a generally planar leaf portion 52 defining a reference plane RP for the hinge structure 50. In one form, the hinge structure leaf portion 52 is provided with one or more through openings 51 toward one end thereof The openings 51 allow the hinge structure 50 to be permanently secured, as by rivets, bolts, or other conventional fasteners to the main panel 23 of an associated hatch cover. Each opening 51 in the leaf portion of hinge structure 50 defines an axis 53.

As shown, the universal adapter 60 is releasably secured toward the second end of the hinge structure 50. In one form, the universal adapter 60 is accommodated within a socket or recess 54, having a marginal edge 55. In one embodiment, web structure 56 extends from the second end of and longitudinally along the hinge structure toward the first end to enhance the rigidity thereof. Preferably, the universal adapter 60 is accommodated within the socket or recess 54 defined by the hinge structure 50 in a manner inhibiting relative rotational movement between the hinge structure 50 and the adapter 60 when the hatch cover moves between closed and open positions. In a most preferred form, the socket or recess 54 is preferably configured to releasably accommodate the adapter 60 while inhibiting relative rotation therebetween.

As shown in FIG. 2, the universal adapter 60 defines multiple openings 62, 64 and 66 disposed in spaced generally parallel relation relative to each other. Moreover, and as shown, the axis 63 defined by the hole 62 in adapter 60 is positioned vertically and, preferably, in laterally offset relation relative to the axis 65 defined by hole 64. The axis 67 defined by hole 66 in adapter 60 is positioned vertically and, preferably, in laterally offset relation relative to both axes 63 and 65 defined by the holes 62 and 64, respectively, of adapter 60.

The multiple openings 62, 64 and 66 in adapter 60 form a pattern extending generally normal to and are all positioned in predetermined relation relative to the hinge structure 50. In a preferred form, the axes 63, 65 and 67 defined by the adapter openings 62, 64 and 66, respectively, are all positioned in predetermined vertical and horizontal relation relative to the hinge structure. That is, the axes 63, 65 and 67 defined by the adapter openings 62, 64 and 66, respectively, are all positioned in predetermined relation relative to the hinge structure reference plane RP. Moreover, in a preferred form, the axes 63, 65 and 67 defined by the adapter openings 62, 64 and 66, respectively, are all positioned in predetermined relation or a predetermined distance PD from a reference location on the hinge structure 50. In one form, the axes 63, 65, 67 are all spaced a predetermined distance PD from a centerline 53 defined by one of the openings or holes 51 in the hinge structure leaf portion 52 (with only the predetermined distance PD of axis 65 relative to the centerline 53 of hole 51 being shown for exemplary purposes). Of course, axes 63, 65 and 67 defined by the adapter openings 62, 64 and 66, respectively, could likewise be positioned in predetermined relation or a predetermined distance PD from another reference location on the hinge structure 50 without detracting or departing from the spirit and scope of the invention. Suffice it to say, in a most preferred embodiment, axes 63, 65 and 67 defined by the adapter openings 62, 64 and 66, respectively, are positioned relative to two different and generally normal planes defined by the hinge structure 50.

In the preferred embodiment, each hole 62, 64 and 66 defined by the universal adapter 60 has a closed marginal edge 68. In a most preferred form, the closed marginal edge 68 of each hole or opening 62, 64 and 66 is generally circular. Moreover, and to further enhance the versatility of the hinge structure 50, the closed marginal edge 68 of the majority of openings 62, 64 and 66 are preferably of different sizes relative to each other.

As will be appreciated, the universal adapter 60 can have differing constructions without detracting or departing from the spirit and scope of the invention. For example, in one form, adapter 60 can be of one-piece construction and be releasably secured to the second end portion of structure 50. In a preferred form, shown in FIG. 4, adapter 60 includes a pair of axially spaced identical apertured inserts or modular structures 60' and 60" positioned and held at opposite ends of the recess 54 defined by the hinge structure 50.

Figure 4:
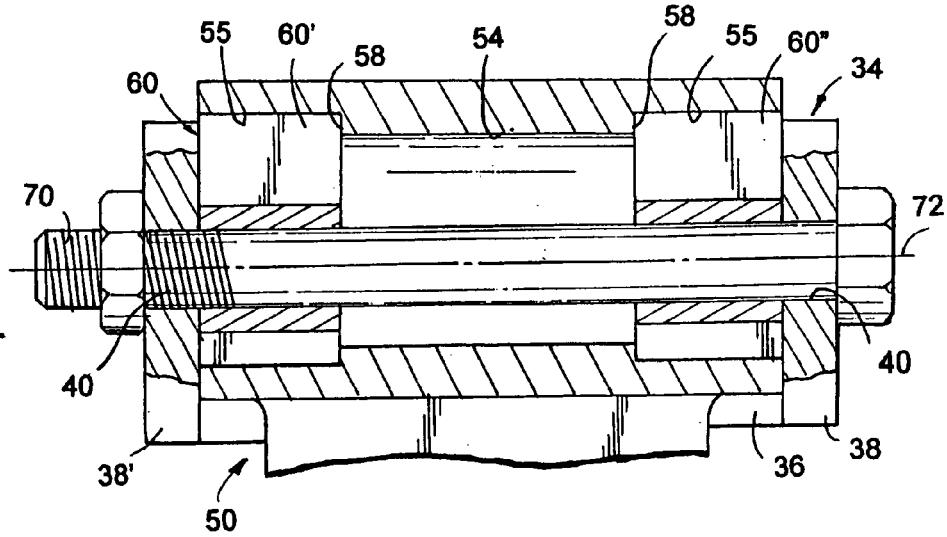
FIG. 4 is an enlarged sectional view taken along line 4—4 of FIG. 2.

The axial spacing between the apertured inserts 60", 60" also adds to the versatility of the hinge structure 50. That is, the hinge pin brackets 34 secured to the railcar roof 12 (FIG. 2) can have different spacings between the upstanding arms 38, 38'. As shown in FIG. 4, the second end portion of hinge structure 50 is preferably designed to be fit between and be embraced by the upright arms 38, 38' to which it is pivotally connected. The axial spacing between the inserts 60', 60" comprising the universal adapter 60 readily allows different hinge structure designs each having a width commensurate with the lateral spacing between the bracket arms 38, 38" to be interchangeably used to connect the hatch cover to brackets of differing widths.

To affect proper positioning of the inserts 60', 60" within socket 54 of the hinge structure 50, and as further shown in FIG. 4, the socket or recess 54 preferably defines shoulders 58 disposed axially inward from opposed sides of the hinge structure 50 for limiting the extent to which each piece 60', 60" can be axially inserted within the recess 54. As will be appreciated, after inserts 60', 60" are positioned in the recess 54 the appropriately sized hinge structure 50 is arranged in operable relation relative to a respective bracket 34, with the upstanding arms 38, 38' of the respective bracket 34 maintaining the modular inserts 60', 60" preferably comprising universal adapter 60 in place relative to hinge structure socket 54.

Figure 5:
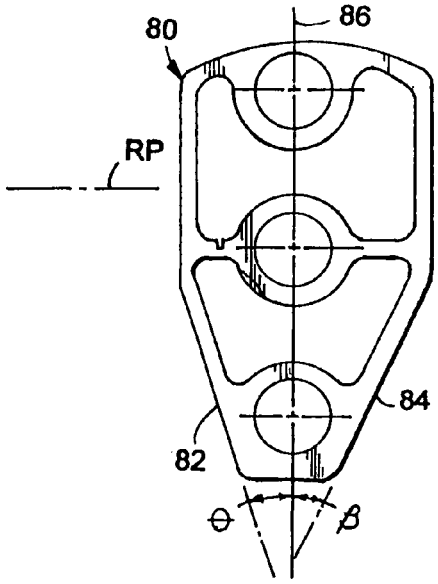
FIGS. 5 through 7 are elevational views of different universal adapters forming part of the hinge structure of the present invention.
Figure 6:
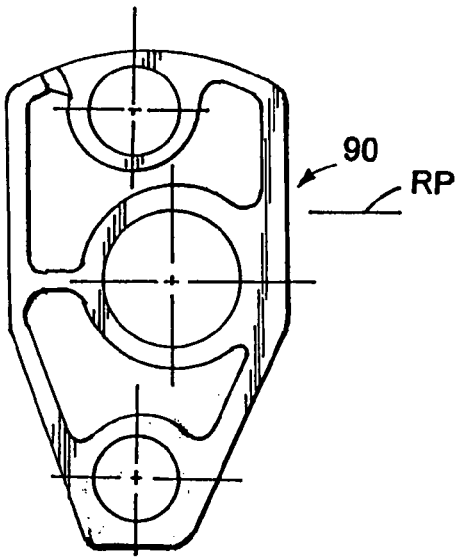
Figure 7:
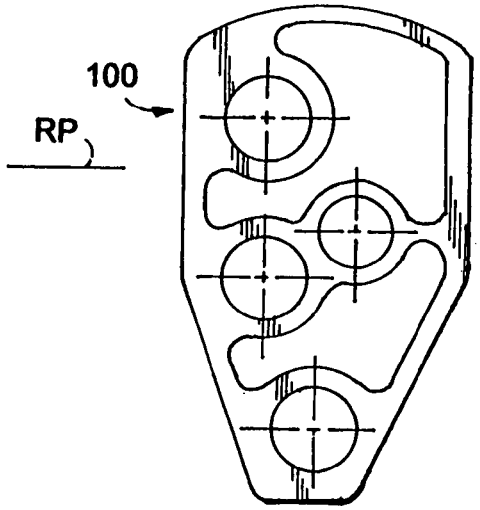

Preferably, and to further enhance the versatility and usefulness of the invention in combination with a variety of different hinge pin brackets (FIG. 2), a plurality of modular inserts or apertured pieces can be interchangeably used to form the universal adapter 60. A few examples of differing types of modular inserts or apertured pieces are shown in FIGS. 5, 6 and 7 and are represented generally by reference numerals 80, 90 and 100. As shown, each insert 80, 90 and 100 has an outer configuration or profile substantially corresponding to each other and to the marginal edge 55 defined by the socket or recess 54 in the hinge structure 50 (FIG. 2) whereby allowing for quick and ready interchangeability between the modular inserts.

In a preferred form, hinge structure 50 and that apertured insert 80, 90 and 100 forming the universal adapter 60 are configured such that an insert 80, 90 and 100 can be releasably accommodated or secured within the socket or recess 54 in a predetermined relationship relative to the remainder of the hinge structure 50. That is, in a preferred embodiment, each insert 80, 90, 100 forming the universal adapter 60 can be received and accommodated within the recess or socket 54 of the hinge structure 50 in only one way or manner. This preferred design insures the vertical and lateral spacings of each hole or opening 62, 64 and 66 in the universal adapter 60 can be quickly and easily predetermined, thus, readily allowing a proper combination of insert 80, 90 and 100 relative to the hinge pin bracket 34 to which structure 50 is to be hingedly connected.

As will be appreciated, there are numerous ways and means for limiting the arrangements of inserts 80, 90 and 100 forming the universal adapter 60 in operable combination with the hinge structure 50. In the form shown on insert 80 in FIG. 5, the outer profile or configuration of each insert includes two diverging angled surfaces 82 and 84. Surface 82 is disposed at an angle $\theta$ relative to the longitudinal centerline 86 of the respective insert while surface 84 is disposed at an angle $\beta$ relative to the longitudinal centerline 86 of the respective insert. The angles $\theta$ and $\beta$ of surfaces 82 and 84 are different from each other. As mentioned, the marginal edge 55 defined by the socket or recess 54 in hinge member 50 has a substantially corresponding profile to that provided on each insert 80, 90 and 100. As such, the apertured pieces 80, 90 and 100 can be inserted in only one manner when arranged in operable combination with structure 50. Moreover, in those adapter designs using two axially spaced inserts, the ability to insert like apertured pieces 60', 60" into operable combination with the hinge structure 50 promotes alignment of the holes or openings 62, 64 and 66 in such like apertured pieces 60', 60"relative to each other.

Preferably, each modular insert 80, 90, 100 includes three or more openings therein. As such, and in the examples shown, the modular inserts 80, 90 and 100 can accommodate different diameter hinge pins in any of at least ten different positions relative to the reference plane RP and the predetermined distance PD between the axes 63, 65 and 67 of each opening or hole 62, 64 and 66 in the universal adapter 60 and a suitable reference location on the hinge structure 50.

Moreover, and as should be appreciated, the apertured pieces 80, 90, 100 are subject to different constructions without detracting or detracting from the spirit and scope of the invention. For example, each modular insert 80, 90, 100 can be machined from a solid block or piece of metal. In a preferred form, however, each modular insert 80, 90, 100 is formed form metal and has a series of sleeve-like openings in different positions whereby reducing the weight of the modular inserts and thereby the overall weight of the hinge structure 50.

Figure 8:
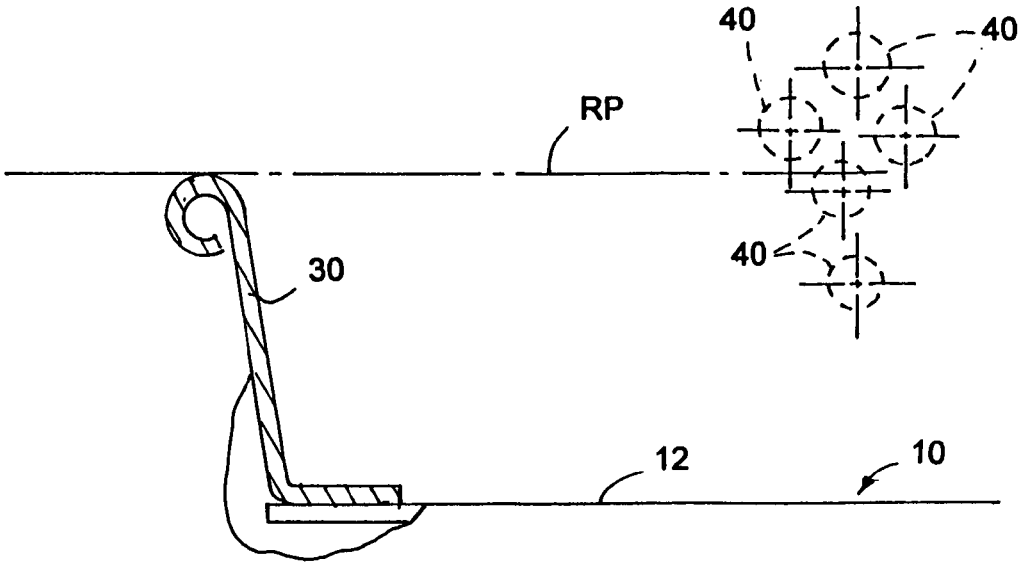
FIG. 8 is a view schematically illustrating the relationship between typical railcar coaming and various hinge pin bracket openings on known existing railroad hopper cars.

As mentioned, various hopper car constructions frequently use different hinge pin-to-coaming separation distances. Just a few examples of the various hopper car constructions having different hinge pin-to-coaming separation distances are schematically shown in FIG. 8. That is, in FIG. 8, various hinge pin locations and openings 40 are schematically illustrated (in phantom lines) relative to the coaming 30. As will be appreciated, either the width of the hatch opening 14 (FIG. 1) or the height of the coaming 30 can also change, depending upon the particular hopper car construction, thus, serving to exacerbate problems with interconnecting and mounting of the cover assembly 20 to the railcar while maintaining an appropriate sealing relationship between the cover assembly 20 and the railcar coaming 30. In addition, certain railcar constructions may also use brackets 34 having hinge pin holes or openings 40 sized to accommodate a hinge pin of a diameter larger or smaller than the hinge pins used to pivotally interconnect other hinge structures to the brackets. As will be appreciated, in the field, almost any available hinge pin will be used to interconnect the hinge structure to the railcar brackets.

Before securing the hinge structure 50 to the hatch cover, the spacing between the upstanding arms 38, 38' of the hinge pin bracket 34 is determined and a hinge structure 50 having an appropriately sized width is selected for connection to the bracket 34. After the hinge structure 50 is secured to the hatch covers 20A through 20D, the relative relation between the hinge pin holes or openings 40 in the brackets the hinge structure 50 is determined and the appropriate universal adapter 60 is selected to affect proper alignment between one of the holes or openings 62, 64, or 66 in the universal adapter 60 with the hinge pin holes or openings 40 in the bracket 34 whereby allowing the hinge pin to be passed therethrough, thus, allowing for the respective hatch cover to be connected to the existing railcar bracket 34 in a manner permitting movement of the respective hatch cover between open and closed positions about a fixed axis. As a result of affecting alignment between one of the holes 62, 64 or 66 in the hinge structure 50 with the hinge pin holes or openings 40 in the railcar brackets 34, this invention furthermore insures the closed hatch cover assembly 20 will be maintained in proper relation relative to the railcar coaming 30 to affect a proper seal therebetween. Thereafter, and should it be determined the universal adapter used in connection with one hinge structure will not necessarily work with other railcar hinge brackets, the only hinge structure change or reconstruction necessary involves simple and easy replacement of one adapter for another adapter rather than having to change or incur the time an expense associated with having to alter or change either the entire hinge structure or the hinge pin brackets on the railcar.

In connecting a railroad car hatch cover for pivotal rotation about a fixed axis to brackets having aligned openings for receiving a pivot pin defining said pivot axis the following procedure is used. Generally speaking, a hinge structure having a generally planar portion for facilitating attachment of said hinge structure to said hatch cover and defining a reference plane is provided. Moreover, a plurality of universal and interchangeable adapters is provided. Each universal adapter allows it to be located toward a second end of the hinge structure. With this invention, each universal adapter includes multiple openings arranged in generally parallel relationship relative to each other, with the openings in the adapter being disposed in a pattern extending generally normal to the hinge structure and at differing distances from the reference plane defined by said hinge structure. The spacing between a majority of the openings in one universal adapter differing from the spacing between the majority of the openings in another universal adapter. Then, that universal adapter having an opening disposed so as to proximate a distance measurable between the pivot axis defined by the aligned openings on the brackets and the reference plane defined by said hinge structure is selected whereby allowing the hinge pin to be passed therethrough whereby interconnecting the hinge structure with the railcar brackets.

From the above, it should be recognized the present invention comprises a significant improvement over the prior art devices by providing a hinge structure having a universal adapter capable of mounting a hatch cover to different types of railcar brackets having hinge pins holes or openings which are oriented or positioned differently relative to coaming on the various railcars and/or which uses hinge pins of differing diameters. Moreover, the present invention accomplishes these results with minimal time and manual effort being required by not having to change the railroad car brackets while concomitantly permitting the hinge structure of the present invention to remain connected to the hatch cover assembly.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. Railcar hatch cover hinge structure for mounting a railcar hatch cover to apertured stationary brackets on a railcar while allowing said hatch cover to pivotally move relative to coaming extending about a through defined by said railcar, said hatch cover hinge structure including a first end configured for attachment toward one side of the hatch cover, and a universal adapter operably secured toward a second end of said hatch cover hinge structure and in laterally spaced relation from said one side of said hatch cover, said universal adapter defining multiple openings disposed in spaced, parallel relation relative to each other, and with at least one of said multiple openings in said adapter being generally aligned with openings defined by said stationary brackets to provide an axis of rotation for said hatch cover hinge structure which is spacially fixed relative to the coaming on said railcar whereby permitting pivotal mounting of said hinge structure and thereby said hatch cover to the stationary brackets on the railcar having hinge pins arranged within predetermined distance ranges relative to the coaming on the railcar.

2. The railcar hatch cover hinge structure according to claim 1, wherein said universal adapter comprises one of a plurality of apertured pieces, with each apertured piece being releasably engageable with said hinge structure in a manner inhibiting rotation of said apertured piece relative to said hinge structure.

3. The railcar hatch cover hinge structure according to claim 1, wherein said universal adapter comprises one of a plurality of modular inserts, and with the second end of said hinge structure being configured to releasably accommodate any one of said plurality of modular inserts in non-rotatable relation relative to said hinge structure.

4. The railcar hatch cover hinge structure according to claim 3, wherein said first end of said hinge structure has a generally planar configuration to facilitate attachment of said hinge structure to a railcar hatch cover.

5. The railcar hatch cover hinge structure according to claim 1, wherein said adapter defines a first opening and a second opening, with said first and second openings being offset relative to each other.

6. The railcar hatch cover hinge structure according to claim 5, wherein said adapter is configured such that an axis defined by said first opening is positioned vertically and in laterally offset relation from an axis defined by said second opening.

7. The railcar hatch cover hinge structure according to claim 5, wherein each opening defined by said adapter is configured with a closed and generally circular marginal edge, and with the closed and generally circular marginal edge of said first opening having a different size than the closed and generally circular marginal edge of said second opening.

8. The railcar hatch cover hinge structure according to claim 1, wherein said universal adapter includes first and second axially spaced and aligned inserts secured toward the second end of said hinge structure.

9. The hinge structure according to claim 8, wherein the second end of the hinge structure is configured with a socket for accommodating said first and second axially inserts in axially spaced and predetermined relation relative to each other.

10. The hinge structure according to claim 8, wherein each insert defines first and second openings therein, and wherein the first and second openings in the first insert axially align with the first and second openings in the second insert after said first and second inserts are secured toward the second end of said hinge structure.

11. The hinge structure according to claim 8, wherein each insert is configured to be secured toward the second end of the hinge structure in a predetermined relation relative to the remainder of the hinge structure.

12. A hinge structure for pivotally connecting a hatch cover to a railcar, said hinge structure including a first end configured for attachment to the hatch cover, and a universal adapter arranged toward a second end of said hinge structure, said universal adapter comprising an apertured piece that is interchangable with other apertured pieces, with each apertured piece defining a series of openings arranged in different patterns relative to each other and with said openings being disposed in spaced, generally parallel relation relative to each other whereby permitting pivotal attachment of said hinge structure and thereby said hatch cover to brackets on the railcar having hinge pins arranged at specified locations relative to coaming on the railcar, and wherein each apertured piece is releasably engageable with said hinge structure in a manner inhibiting relative rotation therebetween.

13. The hinge structure according to claim 12, wherein each apertured piece is configured as a modular insert which is adapted to be releasably accommodated within a socket defined by and toward a second end of said hinge structure.

14. The hinge structure according to claim 12, wherein each modular insert and said socket defined by said hinge structure are configured to inhibit relative rotational movement therebetween.

15. The hinge structure according to claim 12, wherein each opening defined by the apertured pieces is configured with a closed, generally circular marginal edge, and wherein the openings in different apertured pieces are disposed in different patterns relative to each other.

16. The hinge structure according to claim 12, wherein each opening defined by the apertured pieces is configured with a closed, generally circular marginal edge, and wherein a distance across the marginal edge defining the majority of openings in the apertured pieces are of differing sizes relative to each other.

* * * * *